US006808364B2

(12) United States Patent
O'Reilly et al.

(10) Patent No.: US 6,808,364 B2
(45) Date of Patent: Oct. 26, 2004

(54) METHODS AND APPARATUS FOR SEALING GAS TURBINE ENGINE VARIABLE VANE ASSEMBLIES

(75) Inventors: Daniel Padraic O'Reilly, Hamilton, OH (US); Thomas Carl Mesing, Loveland, OH (US); William Terence Dingwell, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 24 days.

(21) Appl. No.: 10/322,116

(22) Filed: Dec. 17, 2002

(65) Prior Publication Data

US 2004/0115051 A1 Jun. 17, 2004

(51) Int. Cl.[7] ..... F01D 9/02
(52) U.S. Cl. ..... 415/160; 415/191
(58) Field of Search ..... 415/160, 162, 415/191, 193

(56) References Cited

U.S. PATENT DOCUMENTS 3,303,992 A 2/1967 Johnson
3,538,579 A * 11/1970 Sprenger ..... 29/281.1
3,964,530 A * 6/1976 Nickles ..... 411/195
4,990,056 A * 2/1991 McClain et al. ..... 415/160
5,039,277 A 8/1991 Naudet
5,281,087 A 1/1994 Hines
5,308,226 A 5/1994 Venkatasubbu et al.
5,593,275 A 1/1997 Venkatasubbu et al.
5,622,473 A 4/1997 Payling
5,807,072 A 9/1998 Payling
6,146,093 A 11/2000 Lammas et al.
6,210,106 B1 * 4/2001 Hawkins ..... 415/160

* cited by examiner

*Primary Examiner*—Ninh H. Nguyen
(74) *Attorney, Agent, or Firm*—William Scott Andes; Armstrong Teasdale LLP

(57) ABSTRACT

A method enables a variable vane assembly for a gas turbine engine including a casing to be assembled. The variable vane assembly includes a seal assembly and at least one variable vane that includes a platform and a trunnion, wherein the platform extends outwardly from the trunnion. The method comprises coupling a seal assembly journal bushing to the variable vane such that the journal bushing is against the trunnion and between the trunnion and the engine casing, and wherein the journal bushing has a substantially constant diameter extending between a first and a second end of the journal bushing, and positioning a substantially flat first washer on the variable vane ledge to prevent contact between the variable vane assembly and the engine casing.

17 Claims, 3 Drawing Sheets

METHODS AND APPARATUS FOR SEALING GAS TURBINE ENGINE VARIABLE VANE ASSEMBLIES

BACKGROUND OF THE INVENTION

This invention relates generally to gas turbine engines, and more specifically to variable stator vane assemblies used with gas turbine engines.

At least some known gas turbine engines include a core engine having, in serial flow arrangement, a fan assembly and a high pressure compressor which compress airflow entering the engine, a combustor which bums a mixture of fuel and air, and low and high pressure turbines which each include a plurality of rotor blades that extract rotational energy from airflow exiting the combustor. At least some known high pressure compressors include a plurality of rows of circumferentially spaced rotor blades, wherein adjacent rows of rotor blades are separated by rows of variable stator vane (VSV) assemblies. More specifically, a plurality of variable stator vane assemblies are secured to the compressor casing wherein each VSV assembly includes an air foil that extends between adjacent rotor blades. The orientation of the VSV air foils relative to the compressor rotor blades is variable to control air flow through the compressor.

At least one known variable stator vane assembly includes a trunnion bushing that is partially positioned around a portion of a variable vane so that the variable vane extends through the trunnion bushing. The assembly is bolted onto the high pressure compressor stator casing with the trunnion bushing between the variable vane and the casing. However, over time, such VSV assemblies may develop possible gas leakage paths, such as between an outside diameter of the airfoil and an inside diameter of the bushing. In addition, another leakage path may develop between an outside diameter of the bushing and an inside diameter of the compressor stator case opening. Such leakage may result in failure of the bushing due to oxidation and erosion caused by the high velocity high temperature air. Furthermore, once the bushing fails, an increase in leakage past the stator vane occurs, which results in a compressor performance loss. In addition, the loss of the bushing allows contact between the vane and the casing which may cause wear and increase the engine overhaul costs.

BRIEF SUMMARY OF THE INVENTION

In one aspect a method for assembling a variable vane assembly for a gas turbine engine including a casing is provided. The variable vane assembly includes a seal assembly and at least one variable vane that includes a platform and a trunnion, wherein the platform extends radially outwardly from the trunnion. The method comprises coupling a seal assembly journal bushing to the variable vane such that the journal bushing is against the trunnion to prevent contact between the trunnion and the engine casing, and wherein the journal bushing has a substantially constant diameter extending between a first end and a second end of the journal bushing, and positioning a first washer on the variable vane ledge to prevent contact between the variable vane assembly and the engine casing, wherein the first washer is substantially flat and contacts the seal assembly journal bushing. The method also comprises positioning the variable vane assembly within an opening extending through the engine casing, and such that variable vane assembly trunnion extends through the opening.

In another aspect of the present invention, a variable vane assembly for a gas turbine engine including a casing is provided. The variable vane assembly includes a variable vane including a platform and a trunnion. The platform extends outwardly from the trunnion and includes an outer wall defining an outer periphery of the platform, and a radially outer surface that extends from the outer wall to the trunnion. The variable vane assembly also includes a seal assembly including a journal bushing and a first washer. The journal bushing includes a first end, a second end, and a substantially cylindrical body extending between the first and second ends, such that a diameter of the body is substantially constant between the first and second ends. The journal bushing is in contact with the trunnion and is configured to prevent contact between the trunnion and the engine casing. The first washer is substantially flat and extends from the platform outer wall towards the trunnion, and is configured to prevent contact between the variable vane platform radially outer surface and the engine casing.

In a further aspect, a compressor for a gas turbine engine is provided. The compressor includes a rotor including a rotor shaft and a plurality of rows of rotor blades, and a casing that surrounds the rotor blades. At least one row of variable vanes is secured to the casing and extends between an adjacent pair of the plurality of rows of rotor blades. Each variable vane includes a platform and a trunnion. The platform includes an outer wall that defines an outer periphery of the platform, and a radially outer surface that extends from the outer wall to the trunnion. A seal assembly is configured to facilitate reducing air leakage through the casing at least one opening and includes a journal bushing and a first washer. The journal bushing includes a first end, a second end, and a substantially cylindrical body extending between the first and second ends, such that a diameter of the journal bushing body is substantially constant between the bushing first and second ends. The journal bushing is in contact with the variable vane ledge and is configured to prevent contact between the ledge and the casing. The first washer is substantially flat and extends from the platform outer wall towards the trunnion. The first washer is configured to prevent contact between the variable vane platform radially outer surface and the casing.

DETAILED DESCRIPTION OF THE INVENTION

Figure 1:
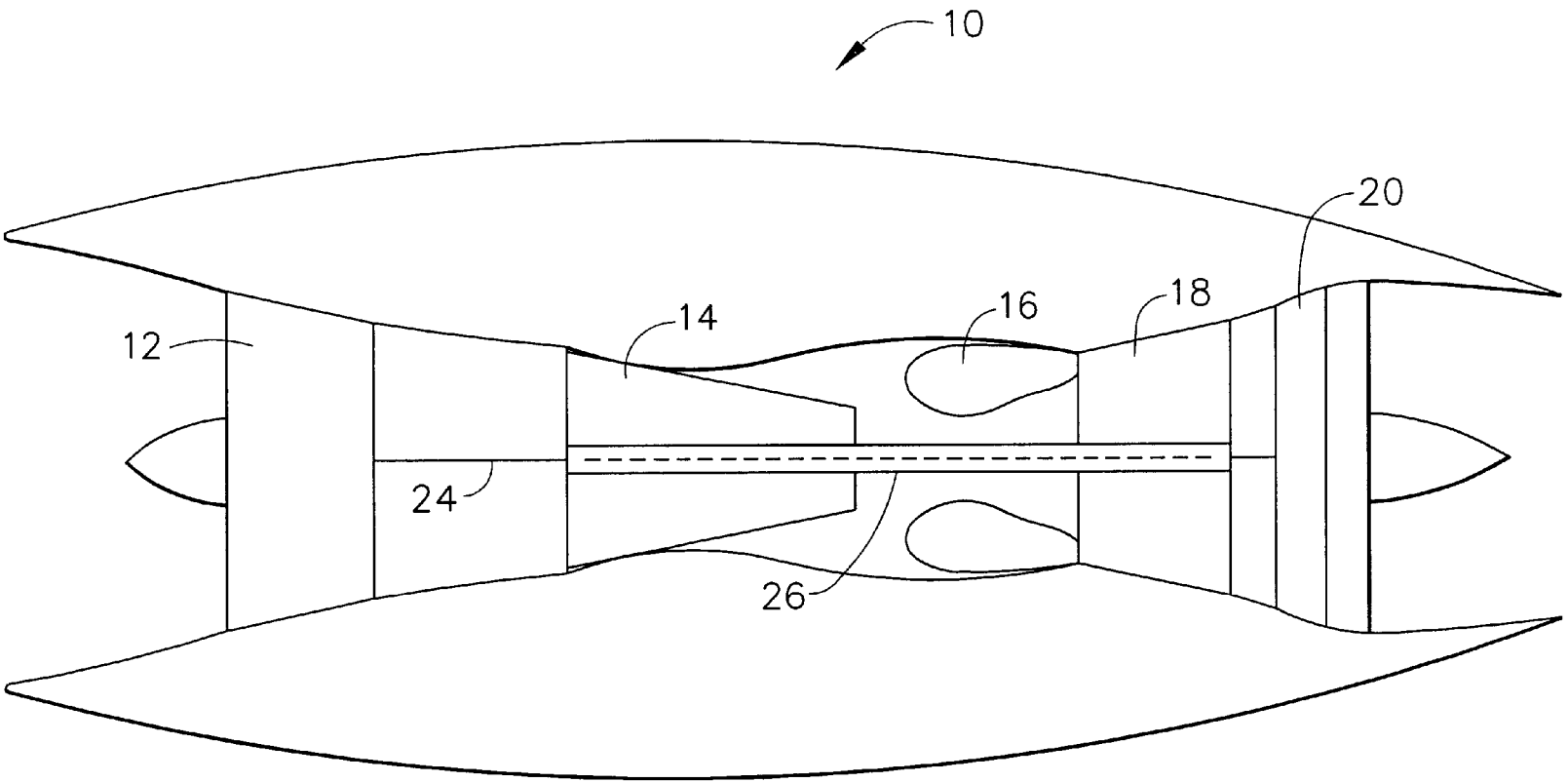
FIG. 1 is schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and- a low pressure turbine 20. Compressor 12 and turbine 20 are coupled by a first shaft 24, and compressor 14 and turbine 18 are coupled by a second shaft 26. In one embodiment, the gas turbine engine is a CF6 available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
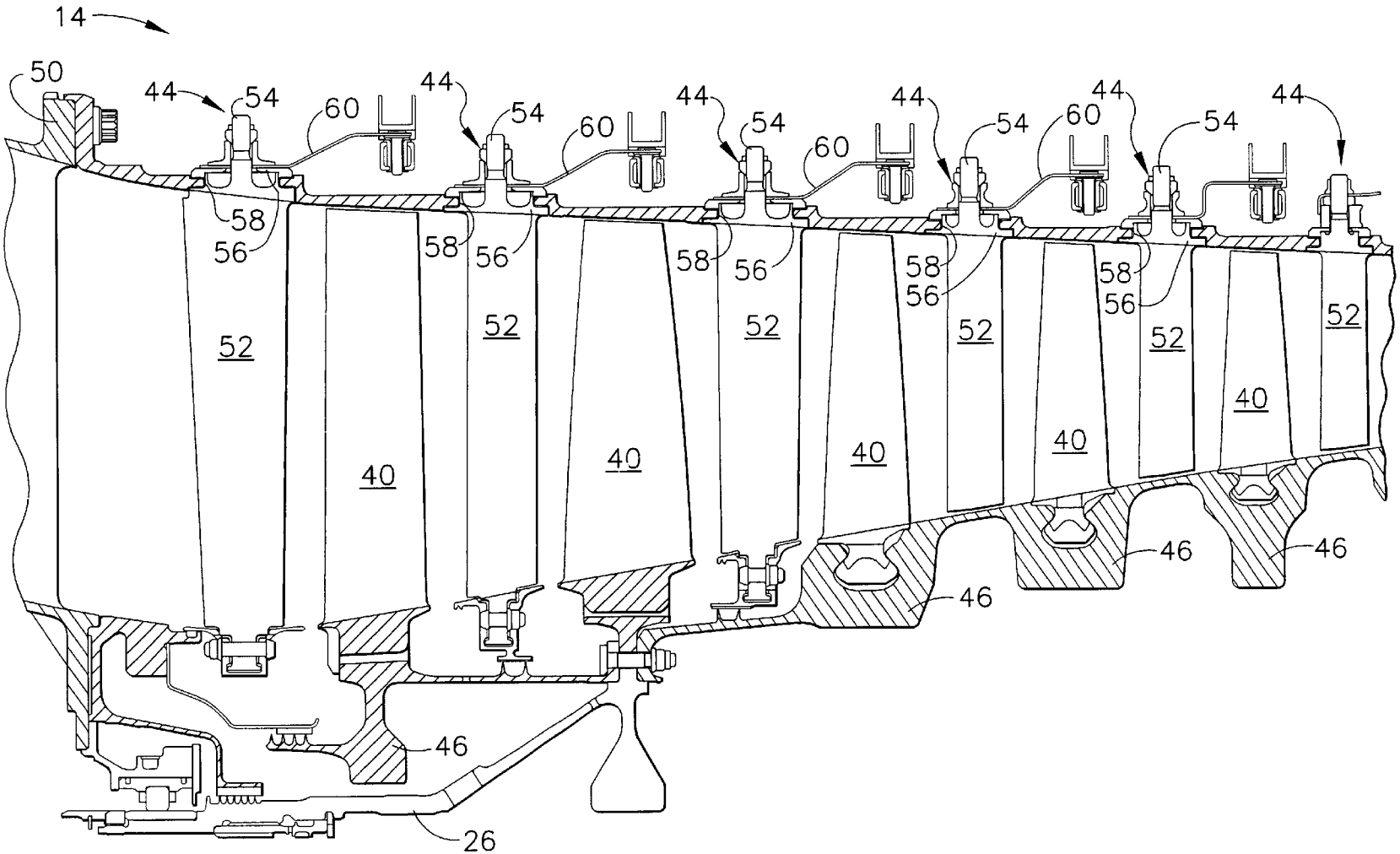
FIG. 2 is partial schematic view of an exemplary gas turbine engine compressor.

FIG. 2 is partial enlarged schematic view of a gas turbine engine compressor, such as compressor 14. Compressor 14 includes a plurality of stages, and each stage includes a row of rotor blades 40 and a row of variable vane assemblies 44. In the exemplary embodiment, rotor blades 40 are supported by rotor disks 46 and are coupled to rotor shaft 26. Rotor shaft 26 is surrounded by a casing 50 that extends circumferentially around compressor 14 and supports variable vane assemblies 44.

Variable vane assemblies 44 each include a variable vane 52 and a vane stem or trunnion 54 that extends substantially perpendicularly from a vane platform 56. More specifically, vane platform 56 extends between variable vane 52 and trunnion 54. Each trunnion 54 extends through a respective opening 58 defined in casing 50. Casing 50 includes a plurality of openings 58. Variable vane assemblies 44 also include a lever arm 60 that extends from each variable vane 52 and is utilized to selectively rotate variable vanes 52 for changing an orientation of vanes 52 relative to the flow path through compressor 14 to facilitate increased control of air flow through compressor 14.

Figure 3:
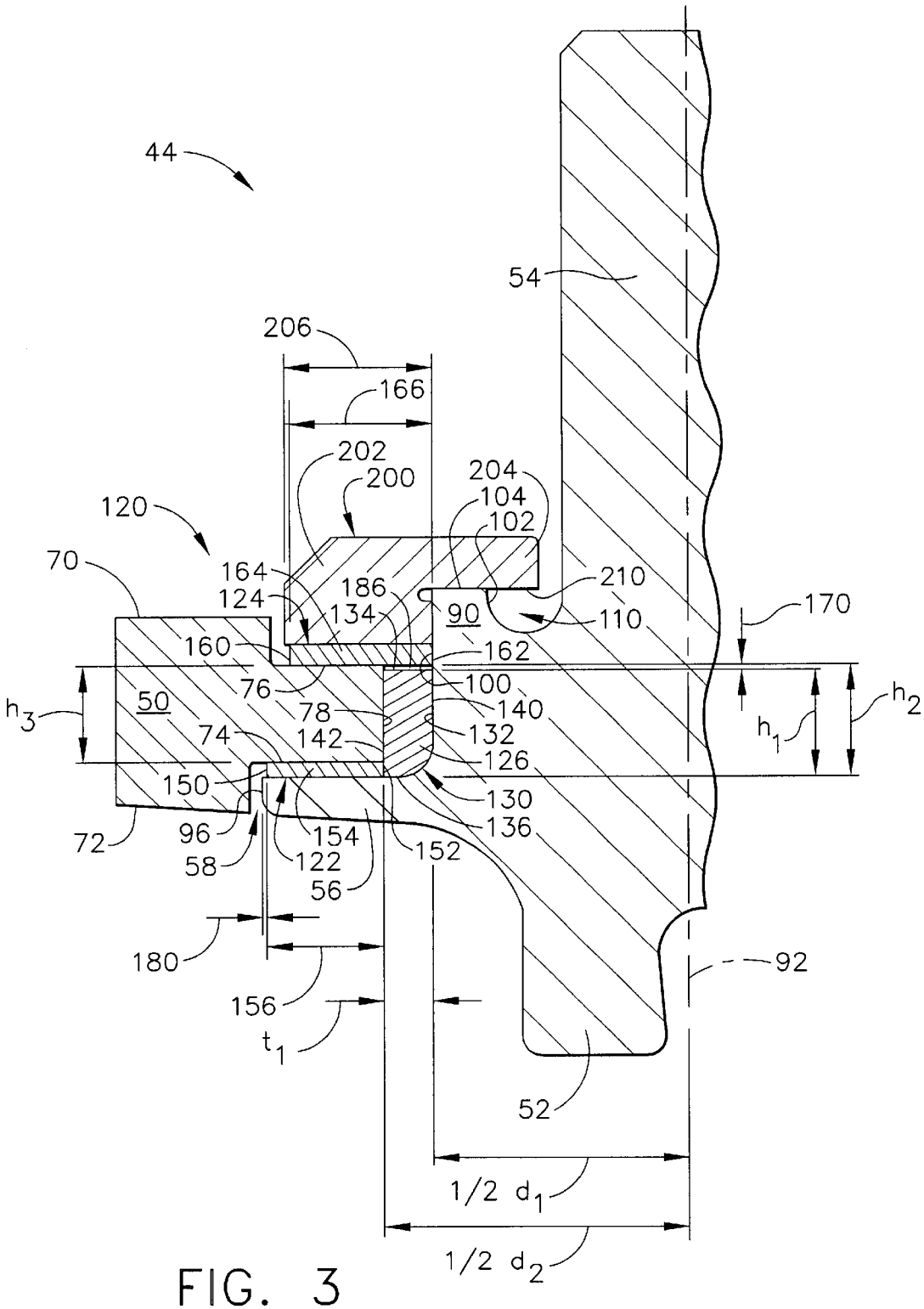
FIG. 3 is an enlarged cross-sectional view of an exemplary variable vane assembly shown in shown in FIG. 2.

FIG. 3 is an enlarged cross-sectional view of a variable vane assembly 44. Each variable vane assembly 44 is a low-boss vane assembly that includes variable vane 52 and trunnion 54 and is coupled to casing 50 through casing opening 58. Each casing opening 58 extends through casing 50 between an outer and an inner surface 70 and 72, respectively, of casing 50. More specifically, each opening 58 includes a radially inner recessed portion 74, a radially outer recessed portion 76, and an inner wall 78 extending substantially perpendicularly therebetween.

Trunnion 54 is formed with an integral annular ledge 90 that extends outwardly from each vane platform 56. In the exemplary embodiment, ledge 90 is substantially parallel to an axis of symmetry 92 extending through vane stem 54, and substantially perpendicular to platform 56. Trunnion 54 also includes an outer sidewall 100, an inner sidewall 102, and an outer edge wall 104 that extends substantially perpendicularly between sidewalls 100 and 102. A variable vane opening 110 is defined within trunnion 54, and facilitates reducing an overall weight of trunnion 54. In an alternative embodiment, trunnion 54 does not include opening 110 or inner sidewall 102.

Each variable vane assembly 44 also includes a seal assembly 120 positioned on each variable vane 52 to facilitate preventing air leakage through casing opening 58. Each seal assembly 120 includes a first washer 122, a second washer 124, and a journal bushing 126. Journal bushing 130 includes an annular body 126 that has an opening 132 extending therethrough between a first end 134 and a second end 136 of body 126. Body 126 is substantially cylindrical such that an inner diameter $d_1$ measured with respect to an inner surface 140 of body 126, and an outer diameter $d_2$ measured with respect to an external surface 142 of body 126, are substantially constant between body ends 134 and 136. Accordingly, a thickness $t_1$ of body 126 is substantially constant along body 126. Journal bushing 130 also has a height $h_1$ measured between ends 134 and 136.

Journal bushing 130 is fabricated from an erosion resistant material. More specifically, journal bushing 130 is fabricated from a material that has relatively low wear and frictional properties. In one embodiment, journal bushing 130 is fabricated from a polyimide material such as, but not limited to Vespel. In an alternative embodiment, journal bushing 130 is fabricated from a metallic material.

First washer 122 includes an outer edge 150, an inner edge 152, and a substantially planar body 154 extending therebetween. Washer body 154 has a length 156 measured between edges 150 and 152, and is fabricated from a material that exhibits low frictional and good mechanical wear characteristics. Washer 122 is fabricated from a composite material matrix that is different than the material used in fabricating journal bushing 130. In one embodiment, washer 122 is fabricated from a composite matrix including teflon, glass, and polyimide materials.

Second washer 124 includes an outer edge 160, an inner edge 162, and a substantially planar body 164 extending therebetween. In the exemplary embodiment, washer body 164 has a length 166 measured between edges 160 and 162 that is shorter than first washer body length 156. In an alternative embodiment, washer 124 and washer 122 are identical. Second washer 124 is fabricated from a material that exhibits low frictional and good mechanical wear characteristics. In the exemplary embodiment, second washer 124 is fabricated from the same material used in fabricating first washer 122.

Journal bushing 130 is positioned radially outward from variable vane outer sidewall 100 such that journal bushing inner surface 140 is against outer sidewall 100. More specifically, journal bushing 130 extends between casing inner wall 78 and variable vane ledge 90 to facilitate preventing contact between variable vane 52 and casing 50. In the exemplary embodiment, journal bushing height $h_1$ is shorter than a height $h_2$ of outer sidewall 100, and is slightly longer than a height $h_3$ of casing inner wall 78. Alternatively, journal bushing height $h_1$, outer sidewall height $h_2$, and casing inner wall height $h_3$ are variably selected. Accordingly, when journal bushing 130 is coupled to outer sidewall 100, journal second end 136 is against vane platform 56, and journal bushing first end 134 is a distance 170 from casing radially outer recessed portion 76.

First washer 122 is positioned against variable vane platform 56 to facilitate preventing contact between casing 50 and variable vane 52. More specifically, washer 122 is positioned radially outwardly from journal bushing 130 with respect to trunnion 54, such that washer inner edge 152 is in contact with journal bushing external surface 142. First washer length 156 enables washer outer edge 150 to remain a distance 180 from platform outer wall 96, such that when variable vane assembly 44 is fully assembled, first washer edge 150 remains within a signature footprint defined between casing radially inner recessed portion 74 and variable vane platform 56. Alternatively, edge 150 extends radially outwardly from the signature footprint defined between casing radially inner recessed portion 74 and variable vane platform 56. In another alternative embodiment, first washer inner edge 152 is positioned against trunnion outer sidewall 100, and journal bushing second end 130 does not contact vane platform 56, but rather is positioned against first washer body 154.

Second washer 124 is positioned against casing 50 to facilitate preventing contact between casing 50 and a spacer 200. Specifically, washer body 164 is in contact with casing radially outer recessed portion 76, such that a gap 186 is defined between second washer 124 and journal bushing 130.

Spacer 200 contacts second washer 124 and is separated from casing radially outer recessed portion 76 by second washer 124. More specifically, spacer 200 includes a first body portion 202 and a second body portion 204 extending from first body portion 202. First body portion 202 has a width 206 that is slightly wider than second washer length 166. Accordingly, when spacer 200 is coupled to variable vane assembly 44, spacer 200 is against outer sidewall 100 such that second washer outer edge 160 is positioned within a signature footprint defined between casing radially outer recessed portion 76 and spacer first body portion 202. Alternatively, edge 160 extends radially outwardly from the signature footprint defined between casing radially outer recessed portion 76 and spacer first body portion 202. A shape of spacer 200 is variably selected and in an alternative embodiment, does not include a portion of first body portion 202.

Spacer second body portion 204 extends from spacer first body portion 202 towards variable vane trunnion 54. When spacer 200 is coupled to variable vane assembly 44, a portion of a radially inner surface 210 of second body portion 204 contacts outer edge wall 104, and the remaining portion of inner surface 210 defines a portion of variable vane opening 110.

During assembly of variable vane assembly 44, initially journal bushing 130 is positioned on variable vane 52 such that journal bushing inner surface 140 is against outer sidewall 100, and such that journal bushing second end 136 is against vane platform 56. Journal bushing height $h_1$ causes bushing first end 134 to define a portion of gap 186. First washer 122 is then coupled to vane platform 56, such that first washer inner edge 152 is in contact with journal bushing external surface 142. In an alternative embodiment, first washer 122 is coupled to vane platform 56 such that first washer inner edge 152 is against trunnion outer sidewall 100 and journal bushing second end 136 is against first washer 122.

Variable vane 52 is then inserted at least partially through casing opening 58 such that first washer 122 is between variable vane platform 56 and casing radially inner recessed portion 74. Additionally, when vane 52 is inserted through opening 58, journal bushing 130 is between vane stem 54 and casing inner wall 78. In the exemplary embodiment, second washer 124 is then positioned such that washer inner edge 162 is in contact with variable vane outer sidewall 100, and washer body 164 is in contact against casing radially outer recessed portion 76. When second washer 124 is coupled within variable vane assembly 44, gap 186 is defined between second washer 124 and journal bushing 130.

Spacer 200 is then positioned against second washer 124 and outer edge wall 104. Lever arm 60 is then positioned over vane stem 54 in contact with spacer 200, before assembly 44 is secured by a fastener (not shown).

During operation, seal assembly 120 facilitates reducing air leakage between vane stem 54 and casing 50, while separating variable vane 54 and casing 50 with a low friction surface. Radial clamping of the mating components facilitates airstream leakage. Furthermore, because journal bushing 130 is fabricated from a material that has better wear properties than the material used in fabricating washers 122 and 124, journal bushing 130 facilitates extending a useful life of seal assembly 120, while maintaining low vane rotational friction between casing 50 and variable vane 52. In addition, because journal bushing 130 is fabricated from a different material than washers 122 and 124, journal bushing 130 is maintained in a tighter clearance against variable vane outer sidewall 100 than other known journal bushings. As a result, engine overhaul costs will be facilitated to be reduced.

The above-described variable vane assemblies are cost-effective and highly reliable. The VSV assembly includes a seal assembly that facilitates reducing gas leakage through the VSV, thus reducing seal assembly wear within the VSV assembly. The seal assembly includes a pair of washers fabricated from a low friction, composite material that facilitates maintaining low vane rotational frictional. The seal assembly also includes a journal bushing that is fabricated from a material that has enhanced erosion properties in comparison to the washers. As a result, the seal assembly facilitates extending a useful life of the VSV assembly in a cost-effective and reliable manner.

Exemplary embodiments of VSV assemblies are described above in detail. The systems are not limited to the specific embodiments described herein, but rather, components of each assembly may be utilized independently and separately from other components described herein. Each seal assembly component can also be used in combination with other seal assembly components. Furthermore, each seal assembly component may also be used with other configurations of VSV assemblies.

While the invention has been described in terms of various specific embodiments, those skilled in the art will recognize that the invention can be practiced with modification within the spirit and scope of the claims.

What is claimed is:

1. A method for assembling a variable vane assembly for a gas turbine engine including a casing, the variable vane assembly including a seal assembly and at least one variable vane that includes a platform and a trunnion, wherein the platform extends radially outwardly from the trunnion, said method comprising:

coupling a seal assembly journal bushing to the variable vane such that the journal bushing is against the trunnion to prevent contact between the trunnion and the engine casing, and wherein the journal bushing has a substantially constant diameter extending between a first end and a second end of the journal bushing;

positioning a first washer on the platform to prevent contact between the variable vane assembly and the engine casing, wherein the first washer is substantially flat and contacts the seal assembly journal bushing;

positioning a second washer in contact with the trunnion and adjacent the journal bushing second end such that the second washer and the journal bushing are separated by a substantially uniform gap defined therebetween: and positioning the variable vane assembly within an opening extending through the engine casing, and such that variable vane assembly trunnion extends through the opening.

2. A method in accordance with claim 1 further comprising positioning a second substantially flat washer adjacent the journal bushing to prevent contact between the engine casing and a spacer coupled to the variable vane assembly.

3. A method in accordance with claim 2 wherein positioning a second substantially flat washer adjacent the journal bushing further comprises positioning a journal bushing to the variable vane that has a thickness that is greater than a thickness of the first washer and the second washer.

4. A method in accordance with claim 2 wherein positioning a second substantially flat washer adjacent the journal bushing further comprises positioning a journal bushing to the variable vane that is fabricated from a first material that is different from a second material used to fabricate at least one of the first and second washers.

5. A variable vane assembly for a gas turbine engine including a casing, said variable vane assembly comprising:

a variable vane comprising a platform and a trunnion, said platform extending outwardly from said trunnion and comprising an outer wall defining an outer periphery of said platform, and a radially outer surface extending from said outer wall to said trunnion; and a seal assembly comprising a journal bushing, a first washer, and a second washer, said journal bushing comprising a first end, a second end, and a substantially cylindrical body extending between said first and second ends, such that a diameter of said body is substantially constant between said first and second ends, said journal bushing in contact with at least one of said variable vane platform and said first washer for preventing contact between said trunnion and the engine casing, said first washer substantially flat and extending from said platform outer wall towards said trunnion, said first washer configured to prevent contact between said variable vane platform radially outer surface and the engine casing, said second washer is substantially planar and contacts said trunnion such that said journal bushing second end and said second washer are separated by a substantially uniform gap that is defined therebetween.

6. A variable vane assembly in accordance with claim 5 wherein, said first washer adjacent said journal bushing first end.

7. A variable vane assembly in accordance with claim 6 wherein said seal assembly journal bushing fabricated from a first material, at least one of said first and said second washer fabricated from a second material different than said journal bushing first material.

8. A variable vane assembly in accordance with claim 6 further comprising a spacer comprising a first portion and a second portion, said first portion contacting a portion of said trunnion, said second washer between said spacer and the engine casing.

9. A variable vane assembly in accordance with claim 6 wherein said journal bushing has a thickness that is thicker than a thickness of at least one of said first washer and said second washer.

10. A variable vane assembly in accordance with claim 6 wherein said seal assembly first washer contacts said journal bushing, such that said journal bushing between said first washer and said trunnion.

11. A compressor for a gas turbine engine, said compressor comprising:

a rotor comprising a rotor shaft and a plurality of rows of rotor blades;

a casing surrounding said rotor blades;

at least one row of variable vanes secured to said casing and extending between an adjacent pair of said plurality of rows of rotor blades, each said variable vane comprising a platform and a trunnion, said platform extending outwardly from said trunnion and comprising an outer wall defining an outer periphery of said platform, and a radially outer surface extending from said outer wall to said trunnion; and a seal assembly configured to facilitate reducing air leakage through said casing at least one opening, said seal assembly comprising a journal bushing, a first washer, and a second washer, said journal bushing comprising a first end, a second end, and a substantially cylindrical body extending between said first and second ends, a diameter of said journal bushing body is substantially constant between said bushing first and second ends, said journal bushing in contact with said trunnion and configured to prevent contact between said trunnion and said casing, said first washer substantially flat and extending radially inwardly from said platform outer wall towards a center axis of symmetry of said trunnion, said first washer configured to prevent contact between said variable vane platform radially outer surface and said casing, said second washer is substantially planar and contacts said trunnion such that said journal bushing second end and said second washer are separated by a substantially uniform gap that is defined therebetween.

12. A compressor in accordance with claim 11 wherein said first washer adjacent said journal bushing first end.

13. A compressor in accordance with claim 12 wherein said seal assembly journal bushing has a first thickness, said first washer has a second thickness, said second washer has a third thickness, said journal bushing first thickness thicker than said first washer second thickness and said second washer third thickness.

14. A compressor in accordance with claim 12 wherein said seal assembly journal bushing fabricated from a first material, said first washer fabricated second material that is different from said journal bushing first material, said second washer fabricated from a third material that is different from said journal bushing first material.

15. A compressor in accordance with claim 12 further comprising a spacer comprising a first portion and a second portion, said second portion contacting said trunnion, said second washer between said spacer first portion and said casing.

16. A compressor in accordance with claim 12 wherein said seal assembly first washer contacts said journal bushing, such that said journal bushing between said first washer and said trunnion.

17. A compressor in accordance with claim 12 wherein said seal assembly second washer contacts said trunnion.

* * * * *